United States Patent [19]

Dolecki

[11] 3,966,258

[45] June 29, 1976

[54] MINING BOOM LINKAGE FOR SEPARATE SUMP AND SWING CUTTING

[75] Inventor: Matthew J. Dolecki, Oil City, Pa.

[73] Assignee: Joy Manufacturing Company, Pittsburgh, Pa.

[22] Filed: Dec. 16, 1974

[21] Appl. No.: 532,750

[52] U.S. Cl. ..... 299/76; 299/64

[51] Int. Cl.[2] ..... E21C 27/24

[58] Field of Search ..... 299/18, 64–68, 299/71, 72, 75, 76; 173/38, 43

[56] References Cited

UNITED STATES PATENTS

| | | | |
|---|---|---|---|
| 2,327,928 | 8/1943 | Osgood | 299/72 |
| 2,636,722 | 4/1953 | Fielding | 299/71 X |
| 2,788,202 | 4/1957 | Barrett | 299/76 |
| 3,460,691 | 8/1969 | Wieger et al. | 173/43 X |

*Primary Examiner*—Ernest R. Purser

[57] ABSTRACT

An underground mining apparatus and more particularly an underground mining apparatus having a disintegrating head portion thereof carried by an improved pivotal linkage arrangement.

8 Claims, 3 Drawing Figures

MINING BOOM LINKAGE FOR SEPARATE SUMP AND SWING CUTTING

In the art of underground mining such as applied to the mining of coal from underground seams it is well known to mine solid mineral by providing mobile mining apparatus having disintegrating or mining head means adapted by means of articulated mountings for dislodging the mineral in a substantially continuous manner. In practice such continuous mining operations often have comprised alternating sump and shear cutting cycles wherein the mining head is first actuated through a sump or horizontal cut into the mine face preparatory to a shear cut, and then through the shear or vertical cut across the face surface to dislodge mineral therefrom and to provide clearance for the advancing mining apparatus to pass. Subsequently the mining apparatus is trammed forward into the clearance cut by the mining head on cats or like means to again position the apparatus adjacent the face surface for another sump and shear cutting sequence. Commonly, such continuous mining apparatus has also been adapted to automatically gather and load the mineral dislodged by the repeated cutting sequences into haulage means such as shuttle cars.

Although the articulated mountings provided heretofore for carrying cutter head means on continuous miners have generally served the purposes intended, they have nonetheless been subject to certain undesirable deficiencies. For example, one known cutter mounting comprises pivotal connections adapted to render the cutter head vertically movable for shear cuts. Sumping in this case has been provided by tramming the entire mining apparatus forward to thrust the cutter head into the face surface. This means of sumping has proven to be awkward and wasteful of energy inasmuch as it requires the entire mining machine to be moved. Furthermore the moving maching may be subject to slipping in response to the rearwardly directed reaction forces resulting from the forward thrust of sumping and thus may provide a far less stable and solid base for sumping than if the machine were stationary. Additionally, such slipping of the traction means commonly used, cats for example, may undesirably tear up the mine floor. Furthermore, there may be inherent danger in requiring the operator to conduct sumping and forward tramming simultaneously; safe mining practice would dictate that each of these operations warrants the full and undivided attention of the operator. To overcome these difficulties sumping arrangements such as forwardly sliding cutter head supports have been proposed. However, these typically have been heavy, bulky and complex mechanisms, or have been subject to extreme wear and fouling by bits of mined mineral and other debris.

The hereinabove cited difficulties of prior cutter head mountings are alleviated by the present invention according to which a cutter head adapted for continuous mining is carried by means comprising a compact, simplified and reliable rotary linkage structure whereby sumping operations may be performed independently of apparatus movement over the mine floor and without recourse to complex boom extending mechanisms. The present invention thus permits improved machine stability and ensures maximum traction of the machine to oppose the thrust of sumping. Furthermore, this invention provides for a variable and readily controllable sumping rate.

These and other objects and advantages of the present invention are more fully specified in the following description and illustrations, in which.

Figure 1:
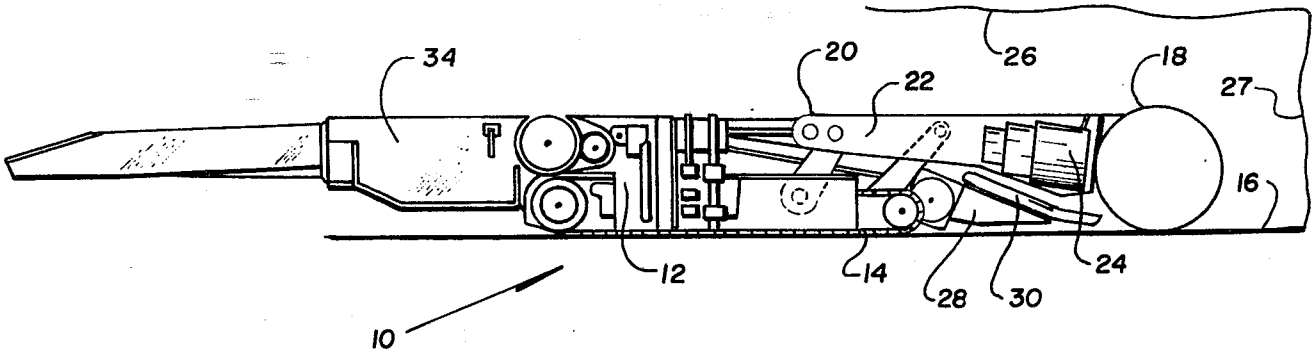
FIG. 1 is a side elevation of an underground mining apparatus including cutter head support means of this invention.

There is generally indicated at 10 in FIG. 1 a mobile underground mining apparatus including pivotal cutter head support assembly 20 constructed in accord with tbe principles of the present invention.

The apparatus 10 may assume any of various well known forms but for purposes of illustration is shown herein as a continuous coal miner comprising a mobile crawler base 14 carrying a frame or main support 12 on which is pivotally mounted adjacent the forward end thereof the support assembly 20 including a forwardly extending boom portion 22 adapted to swing vertically intermediate a mine roof 26 and a floor 16. A mining or cutter head assembly shown schematically at 18 may assume any of numerous well known forms such as a transversely extending cylindrical drum cutter rotatably secured adjacent the forwardmost end of boom 22. A driving motor 24 is connected to head 18 as by a suitable drive train (not shown) to power the head 18 in rotation whereby suitable cutter bit members (not shown) carried thereby are adapted to tear or gouge coal from a mine face 27 as head 18 is advanced thereinto during mining.

A well known gathering head 28 is pivotally carried adjacent the forward end of frame 12 and extends forwardly therefrom generally subjacent support boom 22 to gather the coal dislodged by head 18 inwardly and rearwardly as by means of oscillating gathering arms 30 and a flighted chain conveyor 32 (FIG. 3) toward a well known loading boom 34 also carried by frame 12 adjacent the rearward end thereof and extending rearwardly therefrom. Boom 34 includes thereon any suitable powered conveying means (not shown) such as a flighted chain conveyor similar to the conveyor 32 for conveying coal received from the gathering head 28 rearwardly into any suitable hauling means (not shown) such as shuttle cars or the like.

Figure 2:
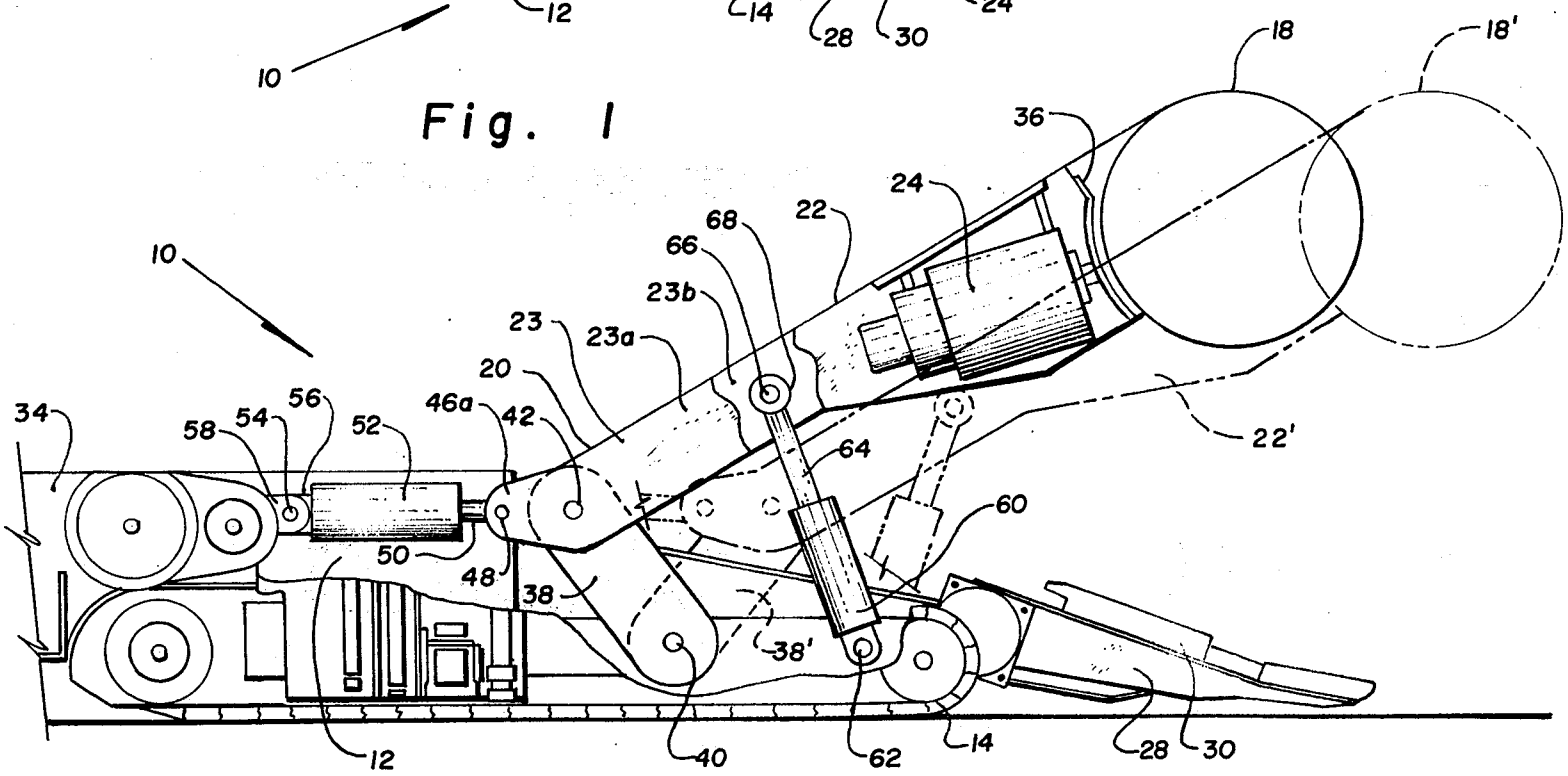
FIG. 2 is an enlarged fragmentary portion of FIG. 1 illustating the support means of this invention.
Figure 3:
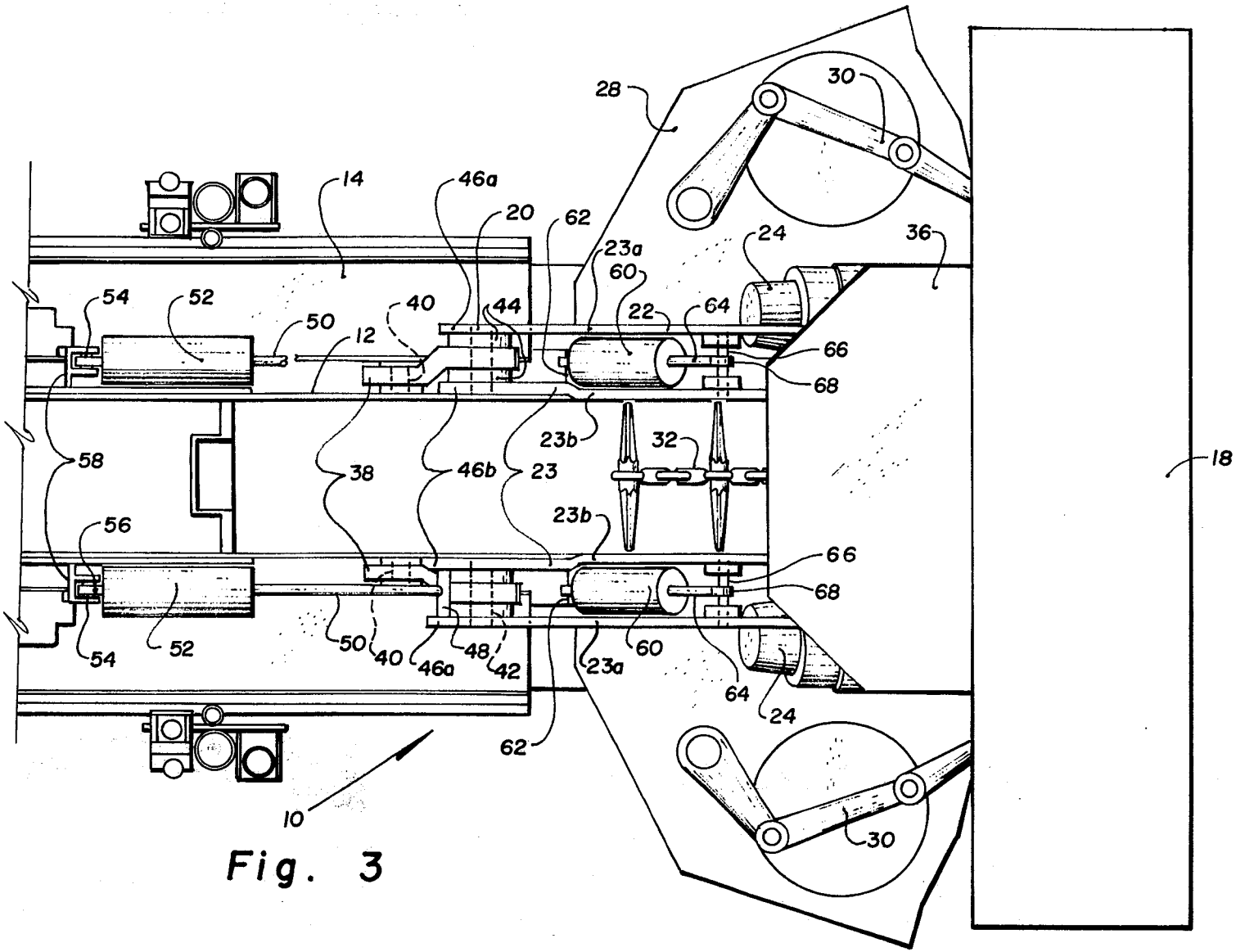
FIG. 3 is a plan view of the apparatus illustrated in FIG. 2.

By reference to FIGS. 2 and 3 it will be seen that the boom 22 as shown comprises two parallel and laterally spaced arms 23 which extend longitudinally adjacent laterally opposed sides of the frame 12 and each of which in turn comprises a pair of laterally spaced parallel arm elements **23*a* and 23*b*. The elements 23*a*-23*b* of one arm 23 are rigidly affixed together and to the corresponding elements of the other arm 23 adjacent the forwardmost ends thereof by a rigid transversely extending head support element 36 having the head 18 rotatably affixed and the motor 24** rigidly affixed thereto.

Adjacent the rearwardmost end of boom 22, each of arms 23 is pivotally affixed to one end of an elongated rotary link means 38 disposed intermediate respective adjacent end portions of arm elements **23*a*–23*b* as by means of a laterally extending pivot pin 42. As shown in FIG. 3 annular bearing or washer elements such as at 44 may be interposed intermediate adjacent surfaces of arm elements 23*a*–23*b* and links 38 to minimize wear due to relative rotation therebetween. As shown, each link 38 extends generally downwardly from pin 42 and is pivotally affixed adjacent the opposed end thereof to the adjacent side of frame 12 as by means of a laterally extending pivot pin 40 whereby the links 38 are rendered rotatable about the respective pins 40 with respect to frame 12 intermediate a fully retracted or rearward position as indicated by solid lines in FIG. 2 at 38, and a fully extended or forward position indicated by broken lines at 38'**.

The arm elements 23*a*–23*b* include respective rearward end portions 46*a*–46*b* which extend rearwardly of pins 42 and are adapted to pivotally secure therebetween cross heads 48 affixed to the forwardmost end of piston rods 50 which extend forwardly from generally longitudinally extensible fluid actuated sumping cylinder assemblies 52. The rearwardmost end of each assembly 52 is pivotally secured to the frame 12 as by means of a laterally extending pivot pin 54 which secures a rearward pivot member 56 of the assembly 52 intermediate laterally spaced legs of a bifurcated bracket 58 rigidly affixed to the frame 12.

The assemblies 52 are advantageously provided with common fluid actuating means (not shown) whereby controlled retraction or extension thereof provides for selective concomitant rotation of links 38 intermediate the extreme positions thereof as indicated at 38 and 38', and the boom 22 carried thereby is thus correspondingly movable generally horizontally intermediate a rearward or retracted position indicated at 22 and a forward or extended position indicated at 22' in FIG. 2. Advantageously, with boom 22 in the rearward or retracted position thereof, head 18 does not extend any substantial distance forwardly of the forward end of head 28.

The support structure 20 further includes a pair of laterally spaced fluid actuated elevation or shear cylinder assemblies 60, one of the assemblies 60 extending generally vertically intermediate a lower forward portion of the frame 12 adjacent each lateral side thereof and the respective overlying leg 23 of boom 22. Each assembly 60 has the lower end thereof pivoted to frame 12 as by means of a laterally extending pivot pin 62, and has the upper end thereof which is shown as a piston rod 64 pivotally affixed intermediate the respective leg elements 23*a*–23*b* at a point spaced forwardly of the respective pivot 42 as by means of a lateral pivot pin 66 which extends between respective leg elements 23*a*–23*b* and passes through an eye 68 rigidly affixed adjacent the uppermost end of rod 64. The assemblies 60 not only provide powered elevating capability, but also support for boom 22 in the manner of a solid pivotal link. More particularly, the location of pivots 66 and 62 is so chosen as to render the assemblies 60 cooperable as solid links with links 38 to provide substantially horizontal linear motion of head 18 upon actuation of assemblies 52.

Advantageously the assemblies 60 are concomitantly operable by common fluid actuating means (not shown) whereby boom 22 is renderd positionable at selectively conrollable elevations intermediate an extreme upper position adjacent roof 26 such as shown in FIG. 2 at 22, and an extreme lower position upwardly adjacent head 28 such as in FIG. 1 at 22.

By virtue of the particular structure of support means 20 described hereinabove, it will be seen that rotation of links 38 intermediate their extreme positions by actuation of assemblies 52 imparts substantially linear and horizontal forward or rearward motion to boom 22 and thus to the head 18, and actuation of assemblies 60 imparts upward or downward vertical motion to the head 18. More particularly, in operation of the apparatus 10 support means 20 renders head 18 movable through the sump and shear cutting cycles required for the continuous mining operations described hereinabove, and through a retract cycle in the following manner. Initially during an operating cycle, head 18 is elevated to a position adjacent the mine roof 26 by controlled extension of assemblies 60 and is fully retracted by retraction of the assemblies 52. The apparatus 10 is trammed forward on crawlers 14 to position the head 18 adjacent an upper part of the face 27 and the forward end of head 28 adjacent a lower part of face 27. In response to controlled extension of the assemblies 52, the links 38 rotate forwardly and the boom 22 carried thereby thrusts the rotating cutter head 18 horizontally and forwardly into the face 27 in a substantially linear path for a sump cut thereinto adjacent the mine roof to the full depth of which the assemblies 52 are capable as indicated at 18' in FIG. 2, or to any intermediate sump depth as desired. It is to be noted that during the sumping operation the miner 10 is completely stationary upon crawlers 14. This reduces the tendency of miner 10 to slip rearwardly in response to the horizontal thrust forces of the sumping operation and provides a very stable, solid base for mining. Furthermore, the fluid power means utilized for sumping permit an easily controllable and variable sumping rate.

After sumping, the assemblies 60 are retracted to move the head 18 through a shear cut substantially vertically and downwardly through the mine face 27 to a point upwardly adjacent the mine floor 16 such that at the end of the shear cut the mined material is piled upon or immediately adjacent head 28 and the head 18 has assumed a position as in FIG. 1 upwardly adjacent the mine floor 16 and forwardly of head 28. Subsequently, assemblies 52 are retracted to rotate links 38 rearwardly thereby retracting head 18 to the solid line position in FIG. 2. The collapsed length and position of assemblies 60 is such as to provide vertical clearance for head 18 as it passes over the forwardmost extremity of the gathering head 28 during retraction. Subsequent to retraction thereof the head 18 may be elevated once again to a position adjacent the roof 26 by extension of assemblies 60 and since the head 18 is wider than the support 12 and gathering head 28 the apparatus 10 may be trammed forward into the cavity produced by the previous shear cut as hereinabove described perparatory to beginning another sump and shear cutting sequence.

Of course it will be understood that the mountings 20 as described hereinabove are equally well adapted to a mining environment wherein mining operations comprise a sump cut adjacent the mine floor followed by a vertically upward shear cut across the face to a position adjacent the mine roof, or to other modes of underground mining.

According to the forgoing description there is provided an underground mining apparatus having improved means for carrying a cutter head thereon, which improved means provides a simplified and reliable sumping arrangement. By virtue of this invention sumping operations in continuous mining are more readily controllable, safer, more efficient and more economical. A further advantage of this invention is that inasmuch as the traction means of base 14 play no direct role in sumping, as for example by driving the machine 10 forward during the sump cut, the traction means used need not be a special type but may instead be any conventional system such as a well known two speed electric traction drive.

Of course it is to be understood that the description hereinabove is directed to a simplified mining apparatus including but one preferred embodiment of the present invention. Such simplification is solely for purposes of clarity and is not intended to unduly limit the scope of the invention described. More particularly, the present invention may be practiced in numerous alternative embodiments and with various modifications thereto without departing from the broad spirit and scope thereof. For example: assemblies 52 and 60 may be other than fluid actuated means, for example screw devices or gear trains; cutter head 18 may be numerous types other than that cited, for example an endless orbital chain cutter; the assemblies 60 may be pivoted at the respective lower ends of head 28 rather than to the frame 12 or may alternatively be pivoted to such other elements as respective links 38 intermediate pivots 42 and 40; likewise the assemblies 52 may be pivoted at their forward ends to link 38 rather than to boom 22; the configuration of links 38 and pivotal connections thereof to frame 12 and boom 22 may likewise be varied within a wide design latitude; and the like. These and other embodiments and modifications having been envisioned and anticipated by the inventor it is requested that this invention be interpreted broadly and limited only by the scope of the claims appended hereto.

What is claimed is:

1. A mining machine comprising: an elongated main support; a cutter head support assembly including link means and an elongated rigid boom member; said link means being pivotally connected to said main support about a first axis fixed with respect to said main support; said boom member having one end portion pivotally connected to said link means about a second axis parallel to said first axis; a cutter head carried by said boom member on the free end thereof opposite said one end portion; said cutter head having an axis of rotation extending transversely of said boom member and having a length along said axis of rotation greater than the width of said main support; and actuator means communicating between said main support and said cutter head support assembly for selectively pivoting said cutter head support assembly about said first axis and for selectively pivoting said boom about said second axis.

2. A mining machine as specified in claim 1 wherein said link means comprise two link members laterally spaced with respect to said main support.

3. A mining machine as specified in claim 1 wherein said actuator means includes at least one selectively extensible actuating mechanism connected between said main support and said boom at said one end portion for pivoting said cutter head support assembly about said first axis.

4. A mining machine as specified in claim 3 wherein said actuator means further includes at least one selectively extensible actuating mechanism connected between said main support and said boom at a point on said boom spaced from said one end portion for pivoting said boom about said second axis.

5. A mining machine as specified in claim 4 wherein said actuator means includes two parallel, laterally spaced selectively extensible actuating mechanisms connected between said main support and said boom at said one end portion, and two parallel, laterally spaced selectively extensible actuating mechanisms connected between said main support and said boom at points on said boom spaced from said one end portion.

6. A mining machine as specified in claim 5 wherein said actuating mechanisms comprise fluid operated expansible chamber devices.

7. A mining machine as specified in claim 1 wherein said main support includes means for rendering said main support selectively mobile.

8. A mining machine as specified in claim 1 wherein said cutter head is a rotary drum cutter head.

* * * * *